United States Patent [19]

Martini

[11] Patent Number: 4,502,552

[45] Date of Patent: Mar. 5, 1985

[54] VIBRATORY ROTARY DRILLING TOOL

[76] Inventor: Leo A. Martini, 2624 Montclair, Mesquite, Tex. 75150

[21] Appl. No.: 461,216

[22] Filed: Jan. 26, 1983

Related U.S. Application Data

[63] Continuation-in-part of Ser. No. 360,202, Mar. 22, 1982, abandoned.

[51] Int. Cl.[3] ..... E21B 7/24

[52] U.S. Cl. ..... 175/56; 175/321

[58] Field of Search ..... 175/56, 321, 299; 464/18, 24; 267/137; 188/378

[56] References Cited

U.S. PATENT DOCUMENTS

| | | | |
|---|---|---|---|
| 3,163,240 | 12/1964 | Bodine | 175/56 |
| 3,307,641 | 3/1967 | Wiggins | 175/56 |
| 4,055,338 | 10/1977 | Dyer | 175/321 X |
| 4,257,245 | 3/1981 | Toelke et al. | 175/321 X |
| 4,303,138 | 12/1981 | Bassinger | 175/321 X |
| 4,331,006 | 5/1982 | Bishop | 464/24 X |

*Primary Examiner*—James A. Leppink
*Assistant Examiner*—Michael Starinsky
*Attorney, Agent, or Firm*—Michael A. O'Neil

[57] ABSTRACT

A tool for improving drill bit penetration in the drilling of oil, gas and water wells and the like is provided. The tool includes a housing and a mandrel connected for co-rotation and limited axial movement under the influence of a spring fluid. The mandrel and drill bit in conjunction with the spring fluid form a spring-mass system having a damped fundamental frequency of oscillation approximately equal to a characteristic frequency of forces ($F_2$) which act on the drill bit during drilling. Resonance causes the forces acting on the bit ($F_2$) to be amplified and magnified, thereby increasing the drilling rate.

27 Claims, 10 Drawing Figures

VIBRATORY ROTARY DRILLING TOOL

RELATED APPLICATION

This application is a continuation-in-part of copending application Ser. No. 360,202, filed Mar. 22, 1982 (now abandoned).

TECHNICAL FIELD

The present invention relates to rotary drilling systems for drilling oil, gas and water wells and the like, and more particularly relates to a spring-loaded housing and mandrel disposed in the drill string to reinforce vertical oscillations of the drill bit.

BACKGROUND ART

Various methods and devices have been proposed and tried for increasing the penetration rate in drilling. An example of such devices are percussion tools as disclosed in U.S. Pat. Nos. 3,612,191 and 3,768,576 to Martini, inventor of the present invention, U.S. Pat. No. 4,054,180 to Bassinger and U.S. Pat. No. 1,892,517 to Pennington. Prior art percussion tools in general have incorporated complicated valving as well as an oscillating hammer activated by a circulating liquid medium. Due to their complexity and high cost, such tools have not been widely accepted by the drilling industry. Air-driven hammer tools have been used but are not generally useful for standard rotary drilling applications. At present, there is no simple, economical and long-lived percussion-type tool for use in rotary drilling systems.

SUMMARY OF THE INVENTION

The present invention provides a new and useful improvement in rotary drilling systems which increases the rate of drill bit penetration. In preferred form, a specially adapted tool is located in the drill string immediately above the bit. The tool, bit and drill string cooperate together to increase the useful energy applied to the bit for formation disintegration.

The tool of the present invention includes a tubular housing adapted to be secured to a drill string, a mandrel reciprocally mounted to the housing for rotation with the housing and connected to a drill bit, and a spring, preferably of compressible fluid, located between the housing and the mandrel. The bit and mandrel are secured together and, for computational purposes, may be considered a single mass. The bit and mandrel coupled with the spring form a spring-mass vibrating system having a known fundamental or natural frequency of oscillation. While drilling, forces on the bit vary periodically, thereby producing vertical oscillations in the mass of the system. The spring-mass natural frequency of the bit, mandrel, and spring assembly is chosen such that the bit forces excite the spring-mass, thereby causing sympathetic and reinforcing percussion forces on the bit.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figure 1:
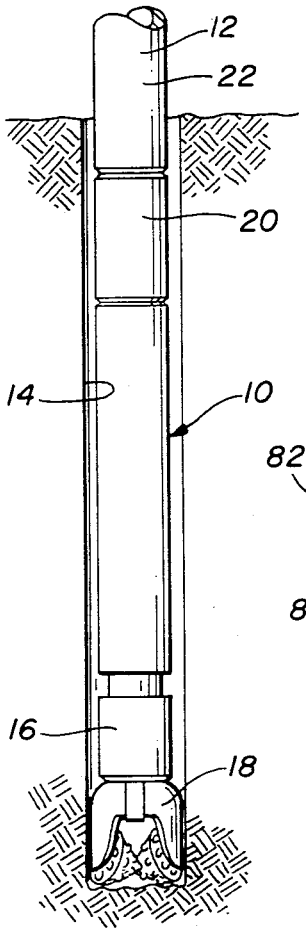
FIG. 1 is a side view of a first embodiment of the vibratory rotary drilling tool of the present invention in a normal borehole environment.

Referring initially to FIG. 1, vibratory drilling tool 10 is shown as a component of drill string 12 in borehole 14. Tool 10 is attached at lower end 16 to drill bit 18 and at upper end 20 to drill collar 22.

Figure 3:
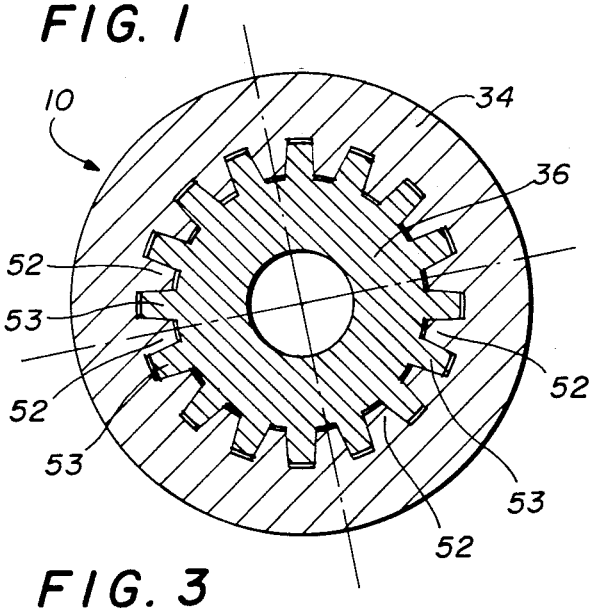
FIG. 3 is a sectional view taken along lines 3—3 of FIG. 2.
Figure 2:
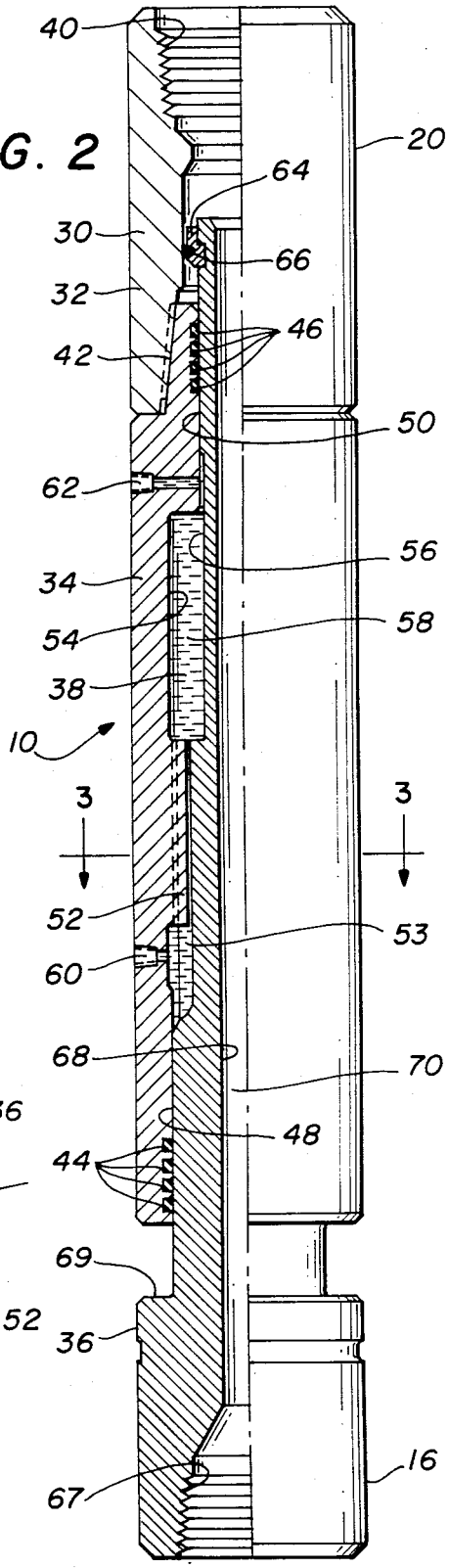
FIG. 2 is a partially broken away side view of a first embodiment of the vibratory drilling tool.

Referring now to FIGS. 2 and 3, tool 10 consists primarily of housing 30, made up of top sub 32 and barrel 34, mandrel 36 and spring 38. Top sub 32 forms the upper encasement of the tool and has internal threads 40 to attach upper end 20 to drill collar 22. Barrel 34 is generally tubular in shape and is connected to top sub 32 at threaded connection 42.

Seals 44 and 46 are provided to fluid-tightly seal barrel 34 and mandrel 36. Seals 44 and 46 are disposed adjacent bearing surfaces 48 and 50 respectively on mandrel 36. In preferred form, bearing surfaces 48 and 50 are widely spaced and specially hardened.

Barrel 34 includes a series of internal longitudinal splines 52. Mandrel 36 includes matching external splines 53 engaging splines 52.

Inner surface 54 of barrel 34 and outer surface 56 of mandrel 36 define chamber 58, which contains spring 38. Chamber 58 is intermediate of seals 44 and 46 and is fluid-tight irrespective of the relative axial placement of barrel 34 and mandrel 36. Sealable passageways 60 and 62 are provided through the walls of barrel 34 and communicate with chamber 58 to facilitate the addition or removal of the fluid of spring 38. In the preferred embodiment, spring 38 is a compressible silicone fluid.

Retainer 64 is attached at the upper extremity of mandrel 36. Retainer 64 is split through the center and is secured to mandrel 36 by O-ring 66. Lower end 16 of tool 10 includes threads 67 for connection to bit 18. Mandrel 36 includes an internal surface 68 which defines drilling fluid passageway 70. Retainer 64 and shoulder 69 of mandrel 36 limit the axial movement of mandrel 36 relative to housing 30.

In operation, torque from drill string 12 is transferred through housing 30 to mandrel 36 through splines 52 and 53, such that housing 30 and mandrel 36 rotate in unison. Splines 52 and 53 permit limited axial relative movement between mandrel 36 and housing 30. Mandrel 36 may thus be oscillated in response to periodic impulsive bit vibrations. Oscillation of mandrel 36 relative housing 30 will be effected by the spring rate of spring 38 and the combined mass of bit 18 and mandrel 36. The applied weight or other force applied by drill string 12 will be resiliently transferred through spring 38 to mandrel 36.

Figure 4:
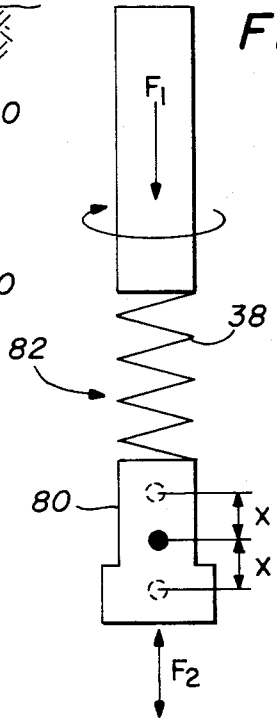
FIG. 4 is a schematic representation of the vibratory drilling tool.

As more clearly illustrated in FIG. 4, the present invention uses bit vibrations to raise the bit energy level for more efficient drill bit penetration. Drill bit 18 vibrates when rotated during drilling, especially when hard brittle earth strata are being drilled. $F_1$ indicates the relative steady state of drill string force acting through string 38 and mandrel 36. $F_1$ tends to push drill bit 18 against the bottom of borehole 14. While drilling, drill bit 18 is under rapid impulsive force $F_2$ at frequency $\omega$. $F_2$ excites mass 80, which is the equivalent mass of mandrel 36 and drill bit 18, causing reciprocation of mass 80 in phase with $F_2$. The spring rate of spring 38 is chosen such that spring-mass system 82, composed of mass 80 and spring 38, has a natural frequency of the same order as $\omega$. The oscillation amplitudes X of mass 80 are magnified and are many times the amplitudes experienced in normal drilling.

Where mandrel 36 and bit 18 have a combined mass of m, and spring 38 has a spring rate of K, spring-mass system 82 has an undamped fundamental frequency $$\omega_n = \frac{\sqrt{\frac{K}{m}}}{2\pi}$$

and a somewhat lower damped fundamental frequency. When $F_2$ oscillates at a frequency substantially equal to the damped fundamental frequency of spring-mass system 82, resonance occurs, and amplitudes X are magnified to $$X = \frac{1}{\sqrt{\left[1-\left(\frac{\omega}{\omega_n}\right)^2\right]^2 + \left[2\left(\frac{C}{C_{cr}}\right)\left(\frac{\omega}{\omega_n}\right)\right]^2}}$$

where $(C/C_{cr})$ is a constant related to the damping of the system. Amplitude X can be magnified by several orders of magnitude even when the frequency match $(\omega/\omega_n)$ is poor and the damping factor $(C/C_{cr})$ is relatively high. Preferably, the ratio $(\omega/\omega_n)$ should be in the range of 0.25 to 1.5, and the ratio $(C/C_{cr})$ should be less than 0.5. The frequency of $F_2$ can be adjusted from the well surface by adjusting the rotational speed of the drill string to take account of the formation being drilled.

It should be noted that the device described herein may also be used as a drilling shock absorber to absorb vibrations produced by the drilling bit if so desired. Tool 10 may be converted to a shock absorber by setting the spring rate K of spring 38 such that the fundamental frequency of spring-mass system 82, $\omega_n$, is relatively low and out of phase with the bit vibration frequency, $\omega$. Alternatively, tool 10 may be constructed such that the internal damping of the tool is above the critically damped condition. A combination of both low natural frequency and high damping may also be employed to convert tool 10 to a drilling shock absorber.

Figure 5:
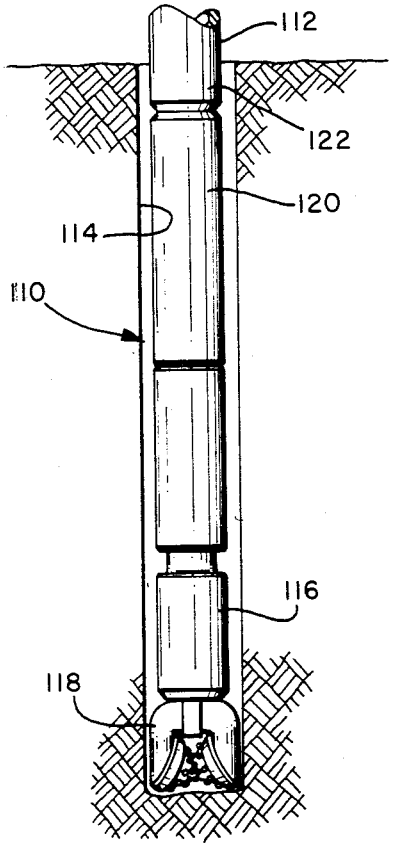
FIG. 5 is a side view of a second embodiment of the vibratory rotary drilling tool of the present invention in a normal borehole environment.

Referring now to FIGS. 5, 6, 7 and 8, there is shown a vibratory drilling tool 110 incorporating a second embodiment of the present invention. The drilling tool 110 incorporates numerous elements and features which are substantially identical in construction and operation to the elements and features of tool 10, which is illustrated in FIGS. 1, 2 and 3. For purposes of orientation, FIG. 5 shows drilling tool 110 as a component of drill string 112 in borehole 114. Tool 110 is attached at lower end 116 to drill bit 118 and, at upper end 120, to drill collar 122.

Drilling tool 110 differs from drilling tool 10 primarily in the structure of mandrel 136 and the quantity and placement of spring 138. Such structural differences cause the damped fundamental frequency of drilling tool 110 to be substantially greater in magnitude than that of drilling tool 10. Therefore, drilling tool 110 is most suitable for use in drilling operations where the impulsive force $F_2$ acting on the drill bit has a relatively high frequency.

Since the magnitude of the damped fundamental frequency of drilling tool 110 will vary in close relation to the magnitude of its undamped fundamental frequency $\omega_n$, which may be expressed as $$\omega_n = \frac{\sqrt{\frac{K}{m}}}{2\pi},$$

it will be apparent that the magnitude of the damped fundamental frequency of drilling tool 110 may be increased substantially by reducing the value of mass m and by increasing the value of the spring rate K for the spring-mass system of drilling tool 110. Accordingly, the damped fundamental frequency of drilling tool 110 is increased substantially over that of drilling tool 10 by providing a mandrel 136 having a relatively low mass. In addition, fluid chamber 158 is provided for containing a relatively small volume of spring 138, thereby causing the value of the spring rate K to be relatively high.

Mandrel 136 is generally tubular, having an internal surface 168 and an outer surface 156. The lower end of mandrel 136 comprises the lower end 116 of drilling tool 110 and has threads 167 for connection with drill bit 118. A drilling fluid passageway 170, for conducting drilling fluid from channel 172 to drill bit 118 during drilling operations, is defined by the internal surface 168 of mandrel 136. The mass of mandrel 136 is reduced substantially by shortening the length thereof. As a result, the upper end 184 of mandrel 136 is disposed at a substantial distance from the upper end 120 of drilling tool 110.

Channel 172 serves as a conduit for drilling fluid and extends from an aperture 124 in the upper end 120 of drilling tool 110 and into passageway 170 of mandrel 136. Channel 172 is affixed to the upper end 120 of drilling tool 110 so that mandrel 136 oscillates with respect to channel 172 during drilling operations. Seals 174 provide a fluid-tight fit between channel 172 and the upper end 120 of drilling tool 110. The lower portion of channel 172 is slideably inserted within drilling fluid passageway 170 at the upper end 184 of mandrel 136. Drilling fluid passageway 170 has a first diameter, between the upper end 184 of mandrel 136 and transition step 171, which is suitable to slideably accept channel 172. At transition step 171, the diameter of passageway 170 decreases abruptly toward the lower end 116 of drilling tool 110. The transition step 171 is located at a predetermined distance from the upper end 184 of mandrel 136 so that mandrel 136 will oscillate freely with respect to channel 172.

A fluid-tight seal is established between channel 172 and the upper end 184 of mandrel 136 by seals 149, which are affixed to mandrel 136. A bearing surface 151 is provided on the outer surface 176 of channel 172 to prevent excessive wear of channel 172, which may be caused by friction as mandrel 136 oscillates. Bearing surface 151 is preferably composed of hard chrome, although other known wear-resistant materials may also be utilized, and includes at least that portion of the outer surface 176 of channel 172 which may be susceptible to frictional wear caused by the oscillation of mandrel 136.

Figure 6:
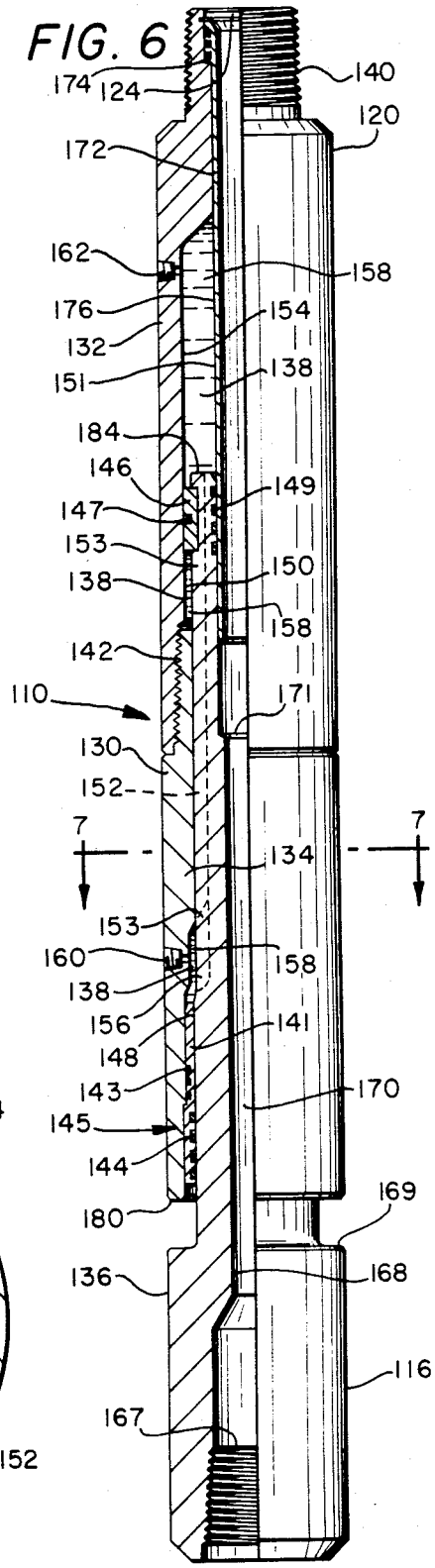
FIG. 6 is a partially broken away side view of a second embodiment of the vibratory drilling tool.
Figure 8:
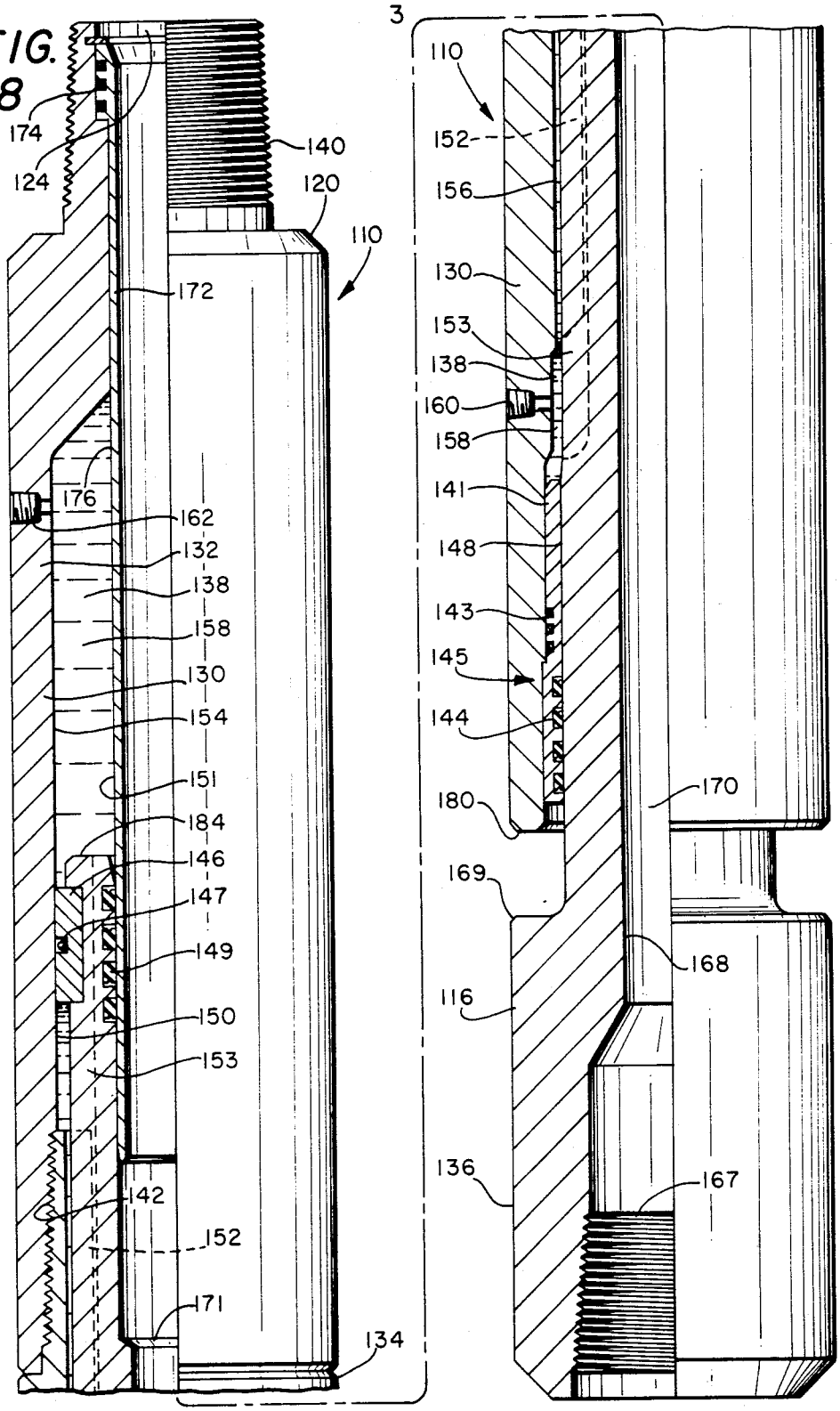
FIG. 8 is an enlargement of the upper and lower portions of the side view shown in FIG. 6.

Although channel 172 is affixed to housing 130 in FIGS. 6 and 8, channel 172 may alternatively be affixed to mandrel 136 for reciprocation therewith. It will be apparent that sealing means similar to seals 149 and 174 may be interposed between channel 172 and the upper end 120 of drilling tool 110 and between channel 172 and mandrel 136, respectively, to establish a fluid-tight relationship therebetween. If such an alternative is utilized, a bearing surface (not shown) similar to bearing surface 151 would be provided on that portion of the outer surface 176 of channel 172 which would be susceptible to frictional wear caused by contact with the upper end 120 of housing 130 as mandrel 136 oscillates.

A portion of mandrel 136, including upper end 184 thereof, is slideably disposed for axial oscillation within housing 130. Housing 130 is generally tubular and includes top sub 132 and barrel 134, which are joined by threaded connection 142. External threads 140, located at the upper end of housing 130, allow the connection of drilling tool 110 to the drill string 112. The housing 130 will remain in a fixed position relative to drill string 112 during drilling operations.

Collar 146 is affixed to mandrel 136 about the upper end 184 thereof and includes two semi-annular halves which are bound together by O-ring 147. Collar 146 serves to guide the upper end 184 of mandrel 136 within housing 130 as mandrel 136 oscillates. To avoid the problem of excessive frictional wear caused by the oscillation of collar 146 with mandrel 136, collar 146 is preferably made of a durable wear-resistant material, such as bronze. Likewise, a portion of the inner surface 154 of housing 130 comprises a bearing surface 150, which is preferably composed of a wear-resistant material such as hard chrome, at least within the oscillating range of collar 146, to avoid excessive frictional wear of housing 130.

Spring 138 is contained by chamber 158, which is defined by a portion of the outer surface 156 of mandrel 136, a portion of the inner surface 154 of housing 130 and a portion of the outer surface 176 of channel 172. A relatively large portion of chamber 158 is disposed immediately above the collar 146 and the upper end 184 of mandrel 136 while the remaining portion of chamber 158 is disposed immediately below collar 146. The portions of chamber 158, which are disposed immediately above and below collar 146, are in fluid communication through several passageways located between collar 146 and the outer surface 156 of mandrel 136. Such passageways may be defined by portions of spines 153 adjacent the upper end 184 of mandrel 136 having whole depths suitable for receiving collar 146 and by the inner surface of collar 146. Spring 138 is contained within chamber 156 by seals 149 and 145 such that the volume of chamber 158 varies in accordance with the axial displacement of mandrel 136 relative to housing 130.

Sealable passageways 160 and 162 are provided through the walls of housing 130 and communicate with chamber 158 to facilitate the addition or removal of the fluid of spring 38.

Seal 145 comprises seals 144 and O-rings 143 which are integrated with seal ring 141. Seal 145 is affixed to housing 130, about mandrel 136, and adjacent shoulder 180. Seals 144 are disposed immediately adjacent mandrel 136 while O-rings 134 are positioned immediately adjacent housing 130. Both seals 144 and O-rings 143 serve to prevent the flow of fluids, such as drilling fluid, into chamber 158 and to contain spring 138 therein. During drilling operations, seal 145 will remain fixed in relation to housing 130. Accordingly, seal 145 may be affixed to housing 130 by appropriate means such as a press-fit, a lock-tight fluid or a snap ring.

Seal ring 141 is preferably composed of a wear-resistant material, such as bronze. Accordingly, a bearing surface 148 is provided on the outer surface 156 of mandrel 136 to prevent excessive frictional wear of mandrel 136 and covers at least that portion of mandrel 136 which is susceptible to frictional wear from seal 145. Bearing surface 148 is preferably composed of a wear-resistant material, such as hard chrome.

The outer surface 156 of mandrel 136 and the inner surface 154 of housing 130 define external longitudinal splines 153 and internal longitudinal splines 152, respectively, as well as a portion of spring fluid chamber 158.

Figure 7:
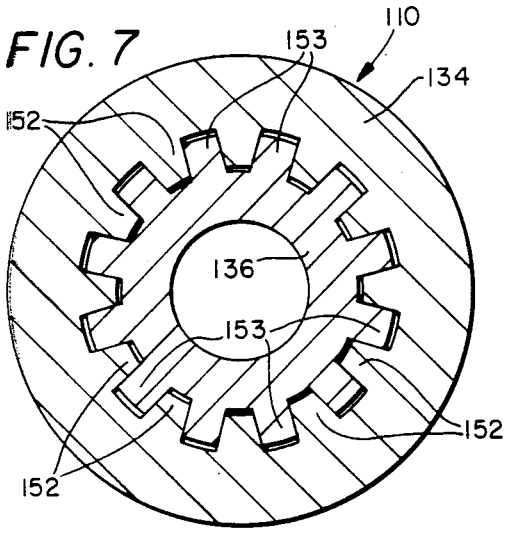
FIG. 7 is a sectional view taken along lines 7—7 of FIG. 6.

External longitudinal splines 153 extend radially from mandrel 136 to engage internal longitudinal splines 152 of housing 130, as shown in FIG. 7. Torque is transmitted from drill string 112 and housing 130 to mandrel 136 through splines 152 and 153 such that mandrel 136 will rotate about its longitudinal axis in a fixed relation to the rotation of housing 130. However, splines 152 and 153 are slideably engaged with respect to their longitudinal axis so that mandrel 136 remains free to oscillate along its longitudinal axis within housing 130. Therefore, mandrel 136 will rotate at the same speed as housing 130 during drilling operations, but may simultaneously oscillate along its longitudinal axis with respect to housing 130.

A relatively steady force, represented by $F_1$ in FIG. 4, is transmitted to mandrel 136 and drill bit 118 through spring 138. Spring 138 is preferably a quantity of compressible fluid, such as silicone fluid. The portion of chamber 158 which is intermediate of collar 146 and seal 145 includes passageways between splines 152 and 153 of mandrel 136 and housing 134, respectively, as depicted in FIG. 7. Likewise, chamber 58 further includes passageways defined by collar 146 and splines 152 of mandrel 136. Movement of spring 138 through these passageways as mandrel 136 oscillates contributes to the damping force on the spring-mass system. Force $F_1$ is resiliently transmitted from housing 130 to mandrel 136 by the compression of spring 138. As $F_1$ is applied to drilling tool 110, housing 130 will tend to move in the direction of $F_1$, toward shoulder 169 of mandrel 136. Therefore, the volume of chamber 158 will tend to decrease with the application of $F_1$ as the upper end 184 of mandrel 136 approaches the upper end 120 of housing 130, thereby pressurizing spring 138. As a result of the pressurization of spring 138, pressure is exerted against the upper end 184 of mandrel 136 such that a force roughly equivalent to $F_1$ is imposed on mandrel 136 by spring 138. In like manner, spring 138 also serves as the spring 82 of the spring-mass system in FIG. 4.

The volume of chamber 158 is of great significance to the embodiment shown in FIGS. 5, 6, 7 and 8. As noted previously, a high spring rate K value is desirable when utilizing the present invention in drilling operations where the impulsive force $F_2$ acting on the drill bit has a relatively high magnitude of frequency. By decreasing the volume of chamber 158 substantially as compared with chamber 58 of the embodiment shown in FIG. 2, and therefore the quantity of spring 138 contained thereby, a substantially increased magnitude of spring rate K is achieved.

Such an increase is easily understood by considering the general expression for the spring rate K of the spring-mass system:

$$K=f/\Delta$$

where f is the magnitude of force required to deflect the mass a unit distance of $\Delta$. It will be apparent that if the volume of chamber 158 is decreased substantially in comparison with chamber 58 of the embodiment in FIG. 2, a substantially greater proportionate change in the volume of chamber 158 will occur per unit deflection of mandrel 136. The increase in the porportionate change in the volume of chamber 158 per unit deflection of mandrel 136 corresponds with a substantial increase in the change in pressure of spring 138 per unit deflection of mandrel 136. Hence, since the magnitude of force acting on mandrel 136 through seal 146 is directly related to the pressure change in spring 138, as discussed previously, a substantially greater force f is required to deflect mandrel 136 a unit distance $\Delta$.

It is desirable, in most applications of drilling tool 110, to provide a lubricant within chamber 158, thereby reducing frictional wear of various components of drilling tool 110. Therefore it may be desirable to contain a mixture or solution of spring 138 and a lubricant within chamber 158, such that substantially all potential wear surfaces remain lubricated during drilling operations. In the alternative, it may be desirable to contain a quantity of lubricant within chamber 158 which has a specific gravity greater than that of spring 138 such that a substantially greater concentration of lubricant will be present in the lower portion of chamber 158 between splines 152 and 153 during drilling operations. The latter alternative is particularly effective in preventing frictional wear of splines 152 and 153, which may be subjected to considerable stress during drilling operations. It will be apparent that a mixture or solution of spring 138 and a lubricant having a specific gravity substantially equivalent to that of spring 138 may be combined within chamber 158 with a quantity of lubricant having a specific gravity greater than such mixture or solution, for certain applications of drilling tool 110.

The type of lubricant used, as well as the quantity of lubricant used, may also affect the spring rate K and therefore the damped fundamental frequency of the spring-mass system of drilling tool 110. For example, the spring rate K may be increased by utilizing a lubricant which is relatively incompressible. When a quantity of incompressible fluid, such as an incompressible lubricant, is contained within chamber 158, the effective volume of chamber 158 is reduced since an equivalent volume of spring 138 is displaced thereby. Therefore, as discussed previously, since a reduction in the volume of chamber 158 causes an increase in the spring rate K and the damped fundamental frequency of the drilling tool 110, the same change may be effected by displacing a quantity of spring 138 with a quantity of incompressible lubricant. It will be apparent that the magnitude of change in the damped fundamental frequency of drilling tool 110 will be proportionate to the relative quantity of spring 138 displaced by the incompressible fluid.

Figure 9:
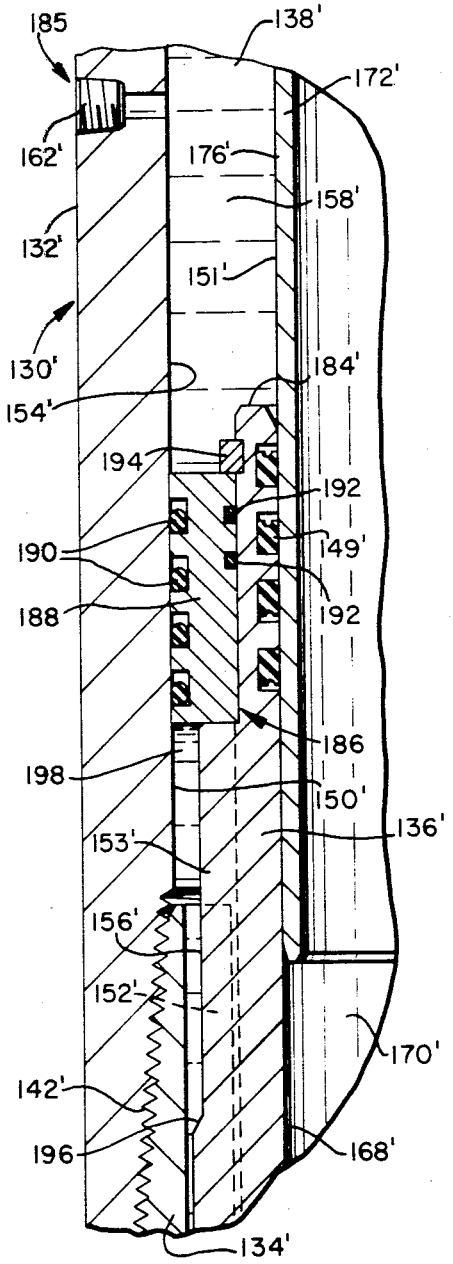
FIG. 9 is a partial sectional view of a third embodiment of the vibratory drilling tool.
Figure 10:
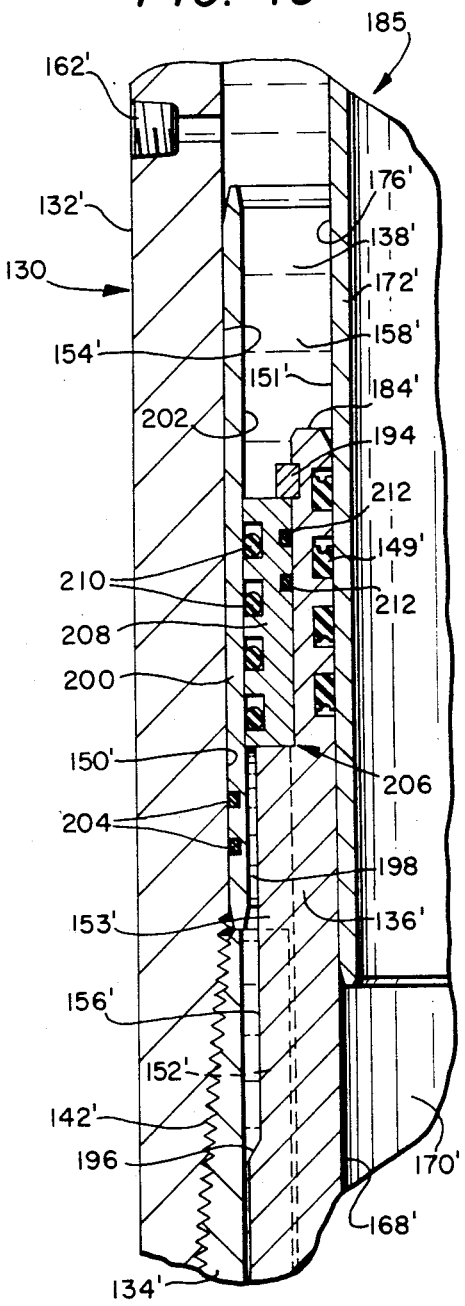
FIG. 10 is a partial sectional view of a modification of the vibratory drilling tool of FIG. 9.

Referring now to FIGS. 9 and 10, there is shown a partial side view of a drilling tool 185 incorporating a third embodiment of the invention. The drilling tool 185 incorporates numerous component parts which are substantially identical in construction and operation to the component parts of drilling tool 110 illustrated in FIGS. 5–8. Such identical component parts are designated in FIGS. 9 and 10 with the same reference numeral utilized in the description of drilling tool 110, but are differentiated therefrom by means of a (′) designation.

Drilling tool 185 differs from the embodiments shown in FIGS. 1–8 primarily in that drilling tool 185 can be modified to vary the damped fundamental frequency thereof. Such modifications alter the spring rate K of drilling tool 185, and thus the damped fundamental frequency thereof, without changing significantly the size of chamber 158′, the quantity of spring 138′ utilized or the mass of mandrel 136′.

Referring more specifically to FIG. 9, there is shown a partial cross sectional view of the portion of drilling tool 185 which surrounds the upper end 184′ of mandrel 136′. The remaining portion (not shown) of drilling tool 185 is substantially identical in structure and operation to drilling tool 110, which is depicted in FIGS. 5–8.

An annular collar 186 is interposed between the outer surface 156′ of mandrel 136′ and the inner surface 154′ of housing 130′ adjacent the upper end 184′ of mandrel 136′. Collar 186 is held against splines 153′ by snap ring 194 such that collar 186 oscillates with mandrel 136′ during drilling operations. It will be apparent that other suitable means for affixing collar 186 to mandrel 136′ may be utilized.

Collar 186 includes O-rings 190 and 192 which are integrated with ring 188. O-rings 190 and 192 are disposed immediately adjacent the inner surface 154′ of housing 130′ and the outer surface 156′ of mandrel 136′ respectively.

Collar 186 performs a number of functions during the operation of drilling tool 185. Collar 186 serves as a sealing means for containing spring 138′ within chamber 158′. Collar 186 also serves as a bearing for guiding the upper end 184′ of mandrel 136′ within housing 130′ as mandrel 136′ oscillates during drilling operations. In addition, collar 186 defines a substantial portion of the surface area against which pressure from spring 138′ acts. As will be discussed in greater detail hereinafter, the thickness of collar 186, or the distance between the inner and outer surfaces of collar 186, determines the effective surface area exposed to spring 138′ and is one variable upon which the damped fundamental frequency of drilling tool 185 depends.

Although longitudinal splines 153' are substantially identical in construction and operation to the longitudinal splines 153 incorporated by drilling tool 110 in FIGS. 5–8, splines 153' differ from splines 153 in certain respects. The importance of such differences will be apparent after discussion of FIG. 10. As splines 153' approach the upper end 184' of mandrel 136' their whole depth, or the distance they extend radially from their respective roots, decreases abruptly at transition step 196, which is located at a predetermined distance from collar 186', thereby causing a sudden decrease in the outside diameter of mandrel 136'. Further, splines 153' terminate at collar 186 and do not define a plurality of passageways which communicate with chamber 158' and spring 138', thus facilitating the establishment of a fluid-tight relationship between collar 186 and mandrel 136'.

Lubrication of drilling tool 185 may preferably be provided by mixing a quantity of lubricant with spring 138' within chamber 158' and by containing a suitable quantity of lubricant 198 between splines 152' and 153' in a manner similar to that discussed with reference to drilling tool 110.

Referring now to FIG. 10, drilling tool 185 is shown having modifications which alter and substantially reduce the damped fundamental frequency thereof. The modifications include the substitution of collar 206 for collar 186 (shown in FIG. 9) and the interposition of sleeve 200 between collar 206 and housing 130'. The purpose of the modifications is to allow the acceptance by drilling tool 185 of collar 206 having a thickness substantially less than that of collar 186.

A sleeve 200, having a thickness substantially equivalent to difference in thicknesses between collars 206 and 186, abuts barrel 134' and splines 152' at the lower end thereof. Sleeve 200 is cylindrical, and is sized to fit tightly within housing 130' such that sleeve 200 will be held in a fixed relation to housing 130' during drilling operations while being removable from housing 130' if desired. O-rings 204 are provided adjacent the lower end of sleeve 200 for sealing the interface between the external surface of sleeve 200 and the inner surface 154 of housing 130'. A bearing surface 202, preferably composed of a wear resistant material such as hard chrome, is provided along the inner surface of sleeve 200 preferably within the oscillating range of collar 206. Bearing surface 202 serves to protect sleeve 200 from excessive wear caused by the oscillation of collar 206 during drilling operations.

Collar 206 is substantially identical to the construction and operation of collar 186, shown in FIG. 9. Accordingly, collar 206 is disposed about mandrel 136' adjacent the upper end 184' thereof and is held against splines 153' by snap ring 194. Collar 206 includes a plurality of O-rings 210 which are disposed immediately adjacent the inner surface of sleeve 200 and O-rings 212 which are disposed immediately adjacent the outer surface 156' of mandrel 136'. O-rings 210 and 212 serve to establish a fluid-tight seal between the collar 206 and the respective surfaces of sleeve 200 and mandrel 136'. Collar 206 may preferably be composed of a wear-resistant material such as bronze.

During drilling operations, mandrel 136' and collar 206 will oscillate relative to housing 130' and sleeve 200. Therefore, transition step 196 is located at a predetermined distance from collar 206 such that mandrel 136' may oscillate freely without significant contact between splines 153' and sleeve 200. Since it may be preferable that drilling tool 185 be capable of accommodating a wide range of sleeve and collar sizes for various applications, the reduction in the outside diameter of mandrel 136' at transition step 196 should be suitable to accommodate a wide range of sleeve thicknesses.

As mentioned previously, the incorporation of collar 206, having a thickness which is substantially less than that of collar 186, adapts drilling tool 185 for application in drilling operations where a relatively lower damped fundamental frequency is desirable. A lower damped fundamental frequency may be desirable, for example, when drilling tool 185 is used with two-cone drill bits rather than the standard three-cone drill bits or when drilling operations require slower drill bit revolutions.

The decrease in the damped fundamental frequency of drilling tool 185 is accomplished by a reduction in the magnitude of the spring-rate K of drilling tool 185, which is caused by a reduction in the combined effective surface area of the upper end 184' of mandrel 136' and collar 206. Since the combined effective surface area of mandrel 136' and collar 206 of FIG. 10 is less than that of mandrel 136' and collar 186 of FIG. 9, a correspondingly smaller quantity of spring 138' is displaced per unit deflection of mandrel 136' and collar 206. A smaller displacement of spring 138' per unit deflection of mandrel 136' causes a lesser pressure differential of spring 138' per unit deflection of mandrel 136'. Since the reduction of the pressure differential of spring 138' per unit deflection of mandrel 136' translates directly into a reduction in the change in force applied downwardly against mandrel 136' and collar 206 by spring 138' per unit deflection of mandrel 136', the result is a reduced spring-rate K for drilling tool 185 in FIG. 10.

It will be apparent that the damped fundamental frequency of drilling tool 185 may be varied across a broad range depending upon the thickness of the collar utilized adjacent the upper end 184' of mandrel 136'. Therefore, drilling tool 185 may be adapted for use in drilling operations having an impulsive force $F_2$ acting on the drill bit with a frequency within a correspondingly broad range.

Drilling tool 185 is easily adapted by substitution of collar 206 for collar 186. Top sub 132' may be disconnected from barrel 134' at the threaded connection 142', thereby allowing insertion of sleeve 200 into housing 130' and allowing access to the upper end 184' of mandrel 136'. Collar 206 may be slipped over the upper end 184' of mandrel 136' until it abuts splines 153'. Collar 206 may then be secured against splines 153' by means of snap ring 194. Tops sub 132' and barrel 134' may then be reconnected by threaded connection 142'. Drilling tool 185 will then be ready for operation following the addition of spring 138' and lubricant 198 in their respective locations. This procedure may be followed whenever adaptation of drilling tool 185 to operations requiring a different damped fundamental frequency is desired.

While certain embodiments of the present invention have been described in detail herein and shown in the accompanying Drawings, it will be evident that various further modifications are possible without departing from the scope of the invention.

I claim:

1. A vibratory rotary drilling tool comprising:

a mass adapted for rectilinear oscillation in response to impulsive forces having a frequency;

a housing in which is slidably mounted at least a portion of said mass;

a spring for providing linear restoring forces to said mass;

a sealed chamber containing said spring within said housing;

said mass being adapted for co-movement with a drill bit, whereby said drill bit, said mass and said spring act as a spring-mass system having a fundamental frequency;

said impulsive forces constituting vibrations of said drill bit as said drill bit is rotated during drilling; and wherein the ratio of the frequency of said impulsive forces of said drill bit to the fundamental frequency of said spring-mass system is substantially within the range of 0.25 to 1.5, and the ratio of actual damping to critical damping of said spring-mass system is substantially 0.5 or less, such that the oscillations of said mass and drill bit are reinforced and amplified thereby.

2. The tool of claim 1 wherein said mass includes a reciprocating mandrel attached to a drill bit.

3. The tool of claim 1 wherein said spring is a contained compressible fluid.

4. A vibratory rotary drilling tool comprising:

a tubular housing adapted to be secured at its upper end to a drill collar of a drill string;

a mandrel reciprocally mounted to said tubular housing for rotation therewith and having a lower end adapted to be secured to a drill bit;

a spring interposed between said housing and said mandrel for providing linear restoring forces to said mandrel, said spring being contained within a sealed chamber defined by the surfaces of said housing and said mandrel, whereby said drill bit and said mandrel, in conjunction with said spring, act as a spring-mass system that reinforces and amplifies oscillations of said drill bit in response to impulsive forces having a frequency, said impulsive forces constituting vibrations of said drill bit as said drill bit is rotated during drilling;

said spring-mass system having a fundamental frequency; and wherein the ratio of the frequency of said impulsive forces of said drill bit to the fundamental frequency of said spring-mass system is substantially within the range of 0.25 to 1.5, and the ratio of actual damping to critical damping of said spring-mass system is substantially 0.5 or less, such that the oscillations of said mandrel and drill bit are reinforced and amplified thereby.

5. The tool of claim 4 wherein said spring is a compressible fluid contained by said chamber.

6. The tool of claim 5, wherein said mandrel is spaced from the upper end of said housing, said spring comprising a compressible fluid disposed within said housing between the upper end thereof and said mandrel.

7. The tool of claim 5, wherein a portion of said chamber is disposed immediately above the upper end of said mandrel and the remainder of said chamber surrounds a portion of said mandrel including the upper end thereof.

8. The tool of claim 5 further including a quantity of lubricant contained by said chamber.

9. A vibratory rotary drilling tool for use in a drill string having a drill bit comprising:

a tubular housing;

a tubular mandrel reciprocally mounted to said tubular housing for rotation and limited reciprocation therewith;

a spring disposed between said housing and said mandrel for resiliently transferring axial forces between said housing and said mandrel;

a surface within said mandrel defining a drilling fluid passageway;

a sealed chamber containing said spring, said chamber being defined by the surfaces of said housing and said mandrel;

said mandrel being adapted for co-movement with a drill bit such that said mandrel and said drill bit in conjunction with said spring form a spring-mass system that reinforces and amplifies oscillations of said drill bit in response to impulsive forces having a frequency, said impulsive forces constituting vibrations of said drill bit as said drill bit is rotated during drilling;

said spring-mass system having a fundamental frequency; and wherein the ratio of the frequency of said impulsive forces of said drill bit to the fundamental frequency of said spring-mass system is substantially within the range of 0.25 to 1.5, and the ratio of actual damping to critical damping of said spring-mass system is substantially 0.5 or less, such that the oscillations of said mandrel and drill bit are reinforced and amplified thereby.

10. The tool of claim 9 further comprising a channel means for directing drilling fluid into said drilling fluid passageway.

11. The tool of claim 10 wherein said spring is disposed within a chamber defined by the surfaces of said housing, said mandrel and said channel means.

12. The tool of claim 9 wherein said spring is disposed between the upper end of said mandrel and the upper end of said housing.

13. The tool of claim 9 wherein said spring comprises a compressible fluid and said damped fundamental frequency is variable for adapting said tool to differing drilling operations.

14. A vibratory rotary drilling tool for being interposed between a drill bit and a drill string comprising:

a housing including an upper end for being threadably connected to the drill string and having inner and outer cylindrical walls;

a mandrel having a lower end for being threadably connected to the drill bit and having inner and outer cylindrical walls, said inner wall of said mandrel defining a drilling fluid passageway between the drill string and the drill bit;

upper and lower means for sealing interposed between said inner wall of said housing and said outer wall of said mandrel;

a portion of said inner wall of said housing and a portion of said outer wall of said mandrel intermediate of said upper and lower means for sealingly defining a chamber;

a spring fluid contained by said chamber;

a plurality of sealable passageways between said outer wall of said housing and said chamber for filling and draining said spring fluid;

longitudinal radial splines extending inwardly of said inner wall of said housing;

longitudinal radial splines extending outwardly of said outer surface of said mandrel and engaging said inwardly extending splines of said housing, such that said housing and said mandrel rotate in unison but may axially reciprocate relative to one another under the influence of said spring fluid;

said mandrel and said spring combining with the drill bit to form a spring-mass system having a fundamental frequency;

wherein said mandrel and the drill bit of said spring-mass system oscillate rectilinearly in response to impulsive forces having a frequency, said impulsive forces constituting vibrations of said drill bit as said drill bit is rotated during drilling; and wherein the ratio of the frequency of said impulsive forces of said drill bit to the fundamental frequency of said spring-mass system is substantially within the range of 0.25 to 1.5, and the ratio of actual damping to critical damping of said spring-mass system is substantially 0.5 or less, such that the oscillations of said mass and drill bit are reinforced and amplified thereby.

15. A vibratory rotary drilling tool for being interposed between a drill bit and a drill string comprising:

a housing including an upper end for being threadably connected to the drill string and having inner and outer cylindrical walls;

a mandrel having an upper end, a lower end for being threadably connected to said drill bit, and inner and outer cylindrical walls, said inner wall of said mandrel defining a drilling fluid passageway between said upper end of said mandrel and said drill bit, said upper end of said mandrel slidably disposed within said housing and spaced from said upper end of said housing;

a conduit for conducting drilling fluid between said drill string and said drilling fluid passageway;

a first sealing means interposed between said inner wall of said housing and said outer wall of said mandrel;

a second sealing means interposed between said inner wall of said mandrel and the outer wall of said conduit;

a third sealing means interposed between the upper end of said housing and said conduit;

a chamber defined by said housing, said mandrel, said conduit and said first, second and third sealing means having a volume which is dependent on the axial position of said mandrel relative to said housing;

a spring fluid contained by said chamber;

longitudinal radial splines extending inwardly from said inner wall of said housing; and longitudinal radial splines extending outwardly of said outer surface of said mandrel and engaging said inwardly extending splines of said housing, such that said housing and said mandrel rotate in unison but may axially reciprocate relative to one another under the influence of said spring fluid.

16. The vibratory rotary drilling tool according to claim 15 further comprising a quantity of lubricant contained by said chamber.

17. The vibratory rotary drilling tool according to claim 15, wherein said first sealing means is disposed adjacent the lower end of said housing and said second sealing means is disposed adjacent said upper end of said mandrel.

18. The vibratory rotary drilling tool according to claim 15, wherein said first and second sealing means are adjacent said upper end of said mandrel such that said chamber is disposed substantially between said upper end of said mandrel and said upper end of said housing.

19. The vibratory drilling tool according to claim 15, wherein said conduit is affixed to said mandrel for reciprocation therewith.

20. The vibratory drilling tool according to claim 15, wherein said conduit is affixed to said housing, such that said mandrel will reciprocate relative to said conduit and said housing during drilling operations.

21. The vibratory rotary drilling tool according to claim 15, wherein said mandrel is adapted for comovement with said drill bit such that said mandrel said drill bit, and said spring fluid cooperate to form a spring-mass system having a damped fundamental frequency, said drill bit oscillates at a known frequency, the ratio of said drill bit frequency to said fundamental frequency is within the range of 0.25 to 1.5, and the ratio of actual damping to critical damping of said spring-mass system is 0.5 or less, such that the oscillations of said drill bit are reinforced and amplified.

22. The vibratory rotary drilling tool according to claim 17, wherein said chamber contains a quantity of lubricant having a specified gravity greater than that of said spring fluid such that said lubricant provides lubrication between said mandrel and said housing during drilling operations.

23. The vibratory rotary drilling tool according to claim 18 further comprising lubricating means for providing lubrication between said housing and said mandrel during drilling operations.

24. The vibratory drilling tool according to claim 21, further comprising means for adjusting the percentage change in said volume of said chamber per unit of axial displacement of said mandrel, thereby allowing variation of said fundamental frequency to adapt said tool for differing drilling operations.

25. The vibratory drilling tool according to claim 21 further comprising means for adjusting the percentage change in volume of said spring fluid per unit of axial displacement of said mandrel, thereby allowing variation of said fundamental frequency to adapt said tool for differing drilling operations.

26. The vibratory rotary drilling tool according to claim 22 further comprising a plurality of sealable passageways between said outer wall of said housing and said chamber for adding and draining said spring fluid and said lubricant.

27. The vibratory rotary drilling tool according to claim 23 wherein said drilling tool further comprising a plurality of sealable passageways between said outer wall of said housing and said chamber for adding and draining said spring fluid, said lubricating means includes a third sealing means interposed between said inner wall of said housing and said outer wall of said mandrel, a lubricant contained between said second and third sealing means and a plurality of passageways through said housing for adding or draining said lubricant.

* * * * *